United States Patent [19]

Cha et al.

[11] 4,149,752

[45] Apr. 17, 1979

[54] OPERATION OF AN IN SITU OIL SHALE RETORT

[75] Inventors: Chang Y. Cha, Bakersfield, Calif.; Robert S. Burton, III, Grand Junction, Colo.

[73] Assignee: Occidental Oil Shale, Inc., Grand Junction, Colo.

[21] Appl. No.: 877,001

[22] Filed: Feb. 13, 1978

[51] Int. Cl.[2] ..... E21C 41/10

[52] U.S. Cl. ..... 299/2; 166/259

[58] Field of Search ..... 299/2; 166/256-261

[56] References Cited

U.S. PATENT DOCUMENTS

| | | | |
|---|---|---|---|
| 3,318,798 | 5/1967 | Kondis et al. | 208/11 |
| 3,941,421 | 3/1976 | Burton et al. | 299/2 |
| 3,951,456 | 4/1976 | Ridley | 299/2 |
| 4,043,595 | 8/1977 | French | 299/2 |
| 4,043,597 | 8/1977 | French | 299/2 |
| 4,043,598 | 8/1977 | French et al. | 299/2 X |

OTHER PUBLICATIONS

"Retorting Ungraded Oil Shale as Related to In-Situ Processing," ACS Preprint, Carpenter et al., 1968.

"Application of Aboveground Retorting Variables To In-Situ Oil Shale Processing," Quarterly of Colorado Schl. of Mines, Carpenter et al., 1968.

*Primary Examiner*—Ernest R. Purser

*Attorney, Agent, or Firm*—Christie, Parker & Hale

[57] ABSTRACT

An in situ oil shale retort containing a fragmented permeable mass of formation particles containing oil shale is formed in a subterranean formation. The void fraction of the fragmented mass is from about 10 to about 25 percent, and the weight average diameter of particles in the fragmented mass is from about 0.02 to about 0.3 foot. Combustion zone feed containing oxygen is introduced to a combustion zone established in the fragmented mass. The rate at which the combustion zone feed is introduced to the combustion zone is controlled for maintaining the modified Reynolds number of gas passing through the combustion zone in the range of from about 0.1 to about 20.

15 Claims, 3 Drawing Figures

OPERATION OF AN IN SITU OIL SHALE RETORT

BACKGROUND

The presence of large deposits of oil shale in the Rocky Mountain region of the United States has given rise to extensive efforts to develop methods of recovering shale oil from kerogen in the oil shale deposits. It should be noted that the term "oil shale" as used in the industry is in fact a misnomer; it is neither shale nor does it contain oil. It is a sedimentary formation comprising marlstone deposit with layers containing an organic polymer called "kerogen", which, upon heating, decomposes to produce liquid and gaseous products. It is the formation containing kerogen that is called "oil shale" herein, and the liquid hydrocarbon product is called "shale oil".

A number of methods have been proposed for processing the oil shale which involve either first mining the kerogen-bearing shale and processing the shale on the surface, or processing the shale in situ. The latter approach is preferable from the standpoint of environmental impact, since the spent shale remains in place, reducing the chance of surface contamination and the requirement of disposal of solid wastes.

The recovery of liquid and gaseous products from oil shale deposits has been described in several patents, one of which is U.S. Pat. No. 3,661,423, issued May 9, 1972, to Donald E. Garrett, assigned to the assignee of this application and incorporated herein by this reference. This patent describes in situ recovery of liquid and gaseous hydrocarbon materials from a subterranean formation containing oil shale by forming an in situ oil shale retort containing a stationary, fragmented permeable body or mass of formation particles containing oil shale within the formation, referred to herein as an in situ oil shale retort. Hot retorting gases are passed through the in situ oil shale retort to convert kerogen contained in the oil shale to liquid and gaseous products, thereby producing retorted oil shale.

One method of forming an in situ oil shale retort is described in U.S. Pat. No. 4,043,595, which is incorporated herein by this reference. According to U.S. Pat. No. 4,043,595, an in situ oil shale retort is formed by excavating a first portion of the formation from within the boundaries of the in situ oil shale retort being formed to form a void, where the surface of the formation defining the void provides at least one free face extending through the formation within the boundaries. A second portion of the formation is explosively expanded toward the void to form the in situ oil shale retort containing a fragmented permeable mass of formation particles. The fragmented permeable mass in the retort has a void fraction which is equal to the ratio of the volume of the void to the combined volume of the void and the space occupied by the second portion of the formation. As used herein the term "void fraction" refers to the ratio of the volume of the voids or spaces between particles in the fragmented mass to the total volume of the fragmented permeable mass of particles in an in situ oil shale retort. For example, in a fragmented mass with a void fraction of 20% , 80% of the volume is occupied by particles, and 20% is occupied by the spaces between particles.

One method of supplying hot retorting gases used for converting kerogen contained in the oil shale, as described in U.S. Pat. No. 3,661,423, includes establishment of a combustion zone in the retort and introduction of an oxygen-containing retort inlet mixture into the retort as an oxygen-supplying gaseous combustion zone feed to advance the combustion zone through the retort. In the combustion zone, oxygen in the combustion zone feed is depleted by reaction with hot carbonaceous materials to produce heat and combustion gas. By the continued introduction of the retort inlet mixture into the retort, the combustion zone is advanced through the retort.

The combustion gas and the portion of the combustion zone feed that does not take part in the combustion process pass through the fragmented mass in the retort on the advancing side of the combustion zone to heat the oil shale in a retorting zone to a temperature sufficient to produce kerogen decomposition, called retorting, in the oil shale to gaseous and liquid products, including gaseous and liquid hydrocarbon products, and to a residual solid carbonaceous material.

The liquid products and gaseous products are cooled by the cooler oil shale fragments in the retort on the advancing side of the retorting zone. The liquid hydrocarbon products, together with water produced in or added to the retort, are collected at the bottom of the retort. An off gas containing combustion gas generated in the combustion zone, gaseous products produced in the retorting zone, gas from carbonate decomposition, and any gaseous retort inlet mixture that does not take part in the combustion process, is also withdrawn from the bottom of the retort. The products of retorting are referred to herein as liquid and gaseous products.

The residual carbonaceous material in the retorted oil shale can be used as fuel for advancing the combustion zone through the retorted oil shale. When the residual carbonaceous material is heated to its spontaneous ignition temperature, it reacts with oxygen. As the residual carbonaceous material becomes depleted in the combustion process, the oxygen penetrates farther into the oil shale retort where it combines with remaining unoxidized residual carbonaceous material, thereby causing the combustion zone to advance through the fragmented oil shale.

The rate of retorting of the oil shale to liquid and gaseous products is temperature-dependent, with relatively slow retorting occurring at 600° F., and relatively rapid retorting of the kerogen in oil shale occurring at about 900° F. and higher temperatures. As the retorting of a segment of the fragmented oil shale in the retorting zone progresses, and less heat is extracted from the gases passing through the segment, the combustion gas heats the oil shale farther on the advancing side of the combustion zone to retorting temperatures, thus advancing the retorting zone on the advancing side of the combustion zone.

The rate of advancement of the combustion zone through the fragmented mass depends upon the rate at which gas is introduced to the combustion zone. When gas is introduced to the combustion zone at a slow rate, the combustion zone advances through the fragmented mass slowly, and shale oil is recovered from the retort slowly. Therefore, the capital costs for preparing and operating an in situ oil shale retort are only slowly recovered.

However, if the rate of introduction of gas to the combustion zone is excessively high, a portion of the shale oil produced in the retorting zone can be consumed by reaction with oxygen passing through the combustion zone into the retorting zone. Furthermore, a high rate of introduction of gas to the combustion zone can result in a high pressure drop along the length of the fragmented mass. Therefore, blowers or compressors used for inducing gas flow through the fragmented mass will operate at relatively high pressure (for example, 5 psig), which requires appreciably more energy for driving the blowers than if the pressure drop is relatively low. The total energy requirements can be relatively high, because a long time can be required for retorting, i.e., 120 days or more. Higher pressure operation also can take a greater capital expenditure for blowers or compressors. Furthermore, some gas leakage from the retort can occur.

Also affecting pressure drop along the length of the fragmented mass is the void fraction of the fragmented mass and the average size and size distribution of particles in the fragmented mass. As the void fraction decreases or the average particle size increases, the pressure drop across the fragmented mass increases. Conversely, as the void fraction increases and the average particle size decreases, pressure drop across the fragmented mass decreases.

SUMMARY OF THE INVENTION

An in situ oil shale retort containing a fragmented permeable mass of formation particles containing oil shale is formed in a subterranean formation containing oil shale. A combustion zone is established in the fragmented mass, and a combustion zone feed containing oxygen is introduced to the combustion zone for advancing the combustion zone through the fragmented mass. The fragmented mass has a selected void fraction of from about 10 to about 25 percent, and the weight average diameter of particles in the fragmented mass is from about 0.02 to about 0.3 foot. The rate at which the combustion zone feed is introduced to the combustion zone is controlled for maintaining the modified Reynolds number of gas passing through the combustion zone in the range from about 0.1 to about 20. This combination of void fraction, weight average diameter of particles, and modified Reynolds number minimizes the cost of shale oil recovered from the retort.

DRAWINGS

These and other features, aspects, and advantages of the present invention will become more apparent when considered with respect to the following description, appended claims, and accompanying drawings, wherein:

DESCRIPTION

Figure 1:
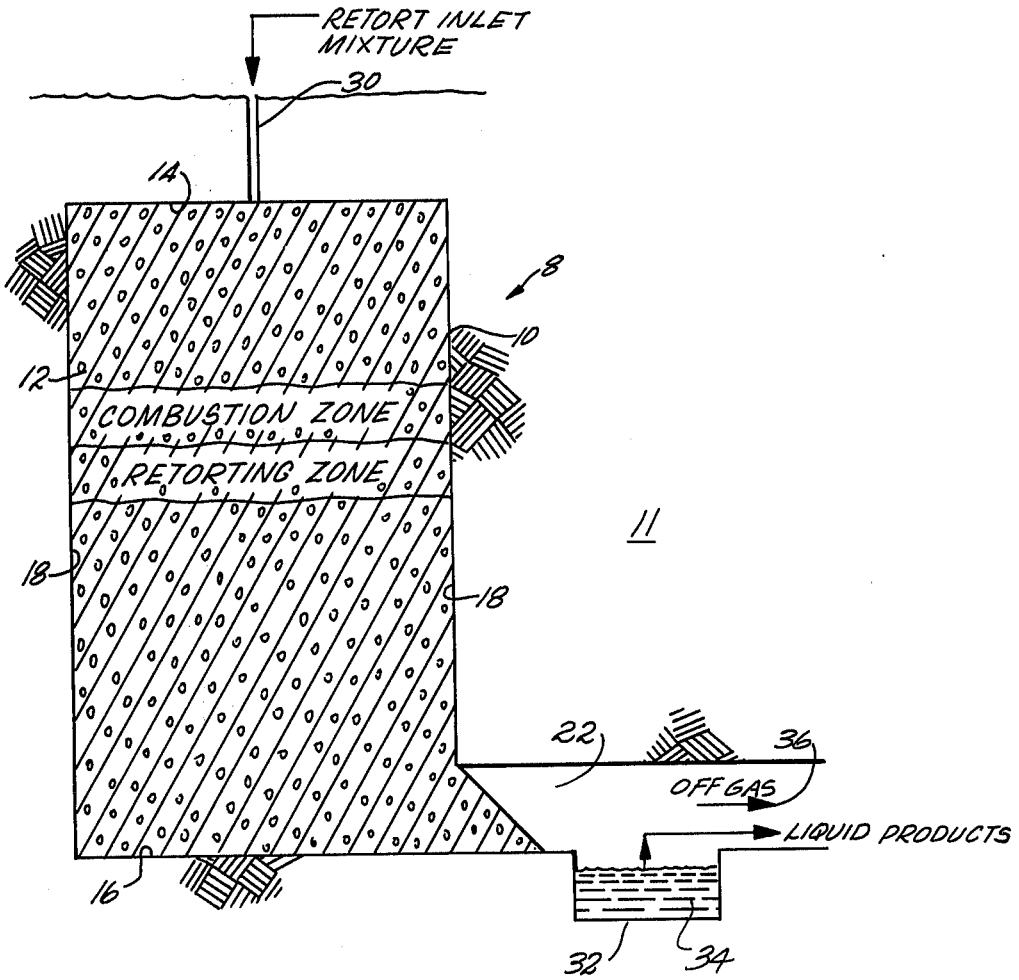
FIG. 1 illustrates schematically in vertical cross-section an in situ oil shale retort operated in accordance with principles of this invention.

Referring to FIG. 1, an in situ oil shale retort 8 is in the form of a cavity 10 in a subterranean formation 11 containing oil shale. The in situ retort contains a fragmented premeable mass 12 of formation particles containing oil shale. The retort has top 14, bottom 16, and side 18 boundaries of unfragmented formation serving as gas barriers. The cavity and fragmented mass of oil shale particles can be created simultaneously by blasting by any of a variety of techniques. Methods for forming an in situ oil shale retort are described in U.S. Pat. Nos. 3,661,423, 4,043,596, 4,043,597, 4,043,598, each of which is incorporated herein by this reference, and the aforementioned U.S. Pat. No. 4,043,595.

A method for forming an in situ oil shale retort in a subterranean formation as described in U.S. Pat. No. 4,043,595 is useful for explanation.

Figure 2:
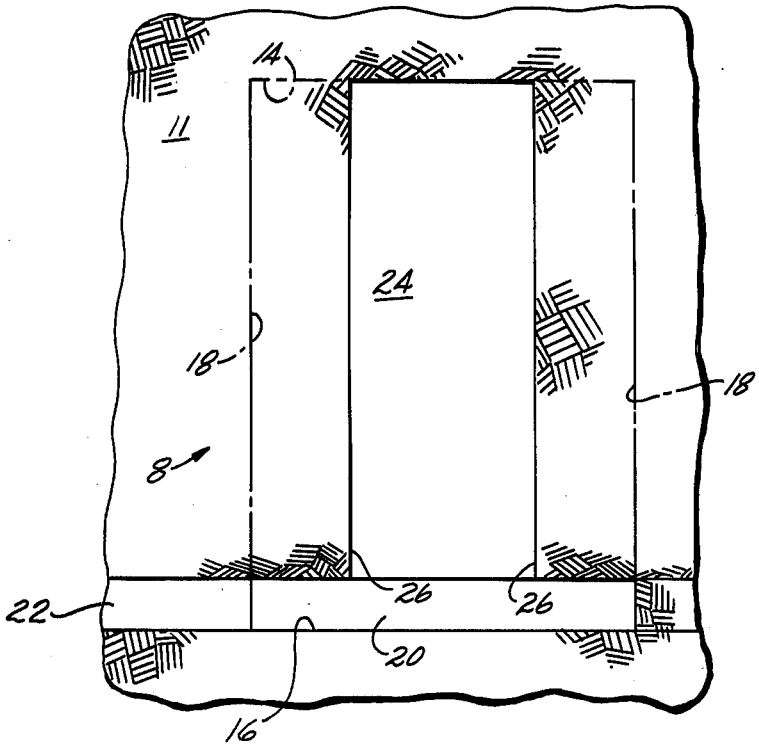
FIG. 2 illustrates in vertical cross-section a subterranean formation in an intermediate stage of preparation for formation of the in situ oil shale retort of FIG. 1.

To prepare an in situ retort, a horizontal room 20 or void is first excavated in the formation, as illustrated in FIG. 2. The room 20, which can have a square floor plan, extends along a level near the lower boundary 16 of the retort 8. A tunnel 22 and a shaft or drift, not shown, connect the room 20 to ground level. The term "tunnel" is used herein to mean a horizontally-extending subterranean passage, whether it be a tunnel, a drift, or an adit. The room 20 and tunnel 22 are formed by conventional mining techniques. Pillars, if any are necessary to support the roof of room 20, are formed of shale left in place during mining.

Next, a portion of the shale contained within the boundaries of the retort 8 under formation is excavated to form a vertically-extending columnar void 24 from the ceiling of room 20 to the upper boundary 14 of the retort 8. Although the columner void can be cylindrical when multi-directional inward expansion of the shale is employed, so that the shale can be expanded symmetrically toward the free face of the columnar void, the columnar void can also be non-cylindrical in cross-section , e.g., oval or square, like a slot, etc. The columnar void can be formed in any number of ways, one of which is to blast it out in its full cross-section in a series of increments moving from the room toward the upper boundary of the retort. The surface of the formation defining the columnar void 24 provides a cylindrical free face 26 extending vertically through the retort 8.

Oil shale formation extending away from the cylindrical free face 26 between the columnar void 24 and the side boundaries of the retort 8 is explosively expanded toward the columnar void to form the fragmented permeable mass 12 of formation particles containing oil shale. The principal expansion is in a direction normal to the cylindrical free face of the columnar void, and some expansion near the bottom is toward the room 20.

Through most of the height of the retort, the void fraction of the resulting fragmented mass depends upon the ratio of the horizontal cross-sectional area of columnar void 24 to the horizontal cross-sectional area of retort 8, which is approximately the same as the area of the floor plan of room 20. A higher void fraction can be present in the vicinity of the room 20 at the bottom.

The distributed void fraction or void volume of the permeable mass of particles in the retort, i.e., the ratio of the volume of the voids or spaces between particles to the total volume of the fragmented permeable mass of particles in the in situ retort 8, is controlled by the volume of the excavated voids into which the formation is expanded. Preferably, the total volume of the excavated voids is sufficently small compared to the total volume of the retort that the expanded formation is capable of filling the voids and the space occupied by the expanded formation prior to expansion. In other words, the volume of the voids is sufficiently small that the retort is full of expanded formation. In filling the voids and the space occupied by the zones of unfragmented formation prior to fragmentation, the particles of the expanded formation become jammed and wedged together tightly so they do not shift or move after fragmentation has been completed. In numerical terms, the total volume of the voids is less than about 30% of the total volume of the retort being formed. Preferably, the volume of the voids is not greater than about 25% of the volume of the retort being formed. This is found to provide a void fraction in the fragmented formation containing oil shale adequate for satisfactory retorting operation. If the void fraction is more than about 25%, an undue amount of excavation occurs without concomitant improvement in permeability. Removal of the material from the voids is costly, and kerogen contained therein is wasted or retorted by costly above-ground methods.

The total volume of the excavated voids is also sufficiently large compared to the total volume of the retort that substantially all of the expanded formation within the retort is capable of moving enough during explosive expansion to fragment and for the fragments to be displaced and/or reoriented. Such movement provides permeability in the fragmented mass to permit flow of gas without excessive pressure requirements for moving the gas. When the fragmented particles containing oil shale are retorted, they increase in size. Part of this size increase is temporary and results from thermal expansion, and part is permanent and is brought about during the retorting of kerogen in the shale. The void fraction of the fragmented permeable mass of shale particles should also be large enough for efficient in situ retorting as this size increase occurs. In numerical terms, the minimum volume of the voids in view of the above considerations is preferably above about 10% of the total volume of the retort. Below this average percentage value, an undesirable amount of power is required to drive the gas blowers causing retorting gas to flow through the retort.

There are local variations in void fraction in the fragmented mass. For example, if the average void fraction is 10%, then regions of the fragmented mass can have such a low void fraction of 5% or lower that these low void fraction regions are bypassed by gas passing through the fragmented mass and are left unretorted. To provide a margin of safety to avoid regions of low void fraction, preferably the average void fraction of the fragmented mass is at least about 15%.

The above percentage values assume that all of the formation within the boundaries of the retort is to be fragmented; that is, there are no unfragmented regions left in the retort. If there are unfragmented regions left within the outer boundaries of the retort, e.g., for support pillars or the like, the percentages would be less.

One factor which controls the size distribution of particles in the fragmented mass is how the explosive used for forming the fragmented mass is distributed within the unfragmented formation adjacent the void. The more uniformly the explosive is distributed in the unfragmented formation, the more uniform are the particles in the fragmented mass. It is desirable to have the fragmented mass contain particles of substantially uniform size with few, if any, large particles to obtain high recovery of shale oil from a retort at economical rates. If there are a substantial number of large particles, i.e., particles greater than about 3 to 4 feet in diameter in the fragmented mass, these larger particles can have a core of raw oil shale and an outer "shell" of retorted oil shale, while adjacent, smaller particles have been completely retorted. Such can occur when temperatures sufficiently high for retorting oil shale have passed by conduction only part way through a large particle. Either the rate of advancement of the retorting zone through the retort must be reduced to retort the core portions of large particles, or the core portions are bypassed as a source of hydrocarbon product with reduced yield.

The average size of particles in the fragmented mass depends upon the amount and distribution of explosive used for expanding formation toward the void or voids. As more explosive is used, the average size of particles in the fragmented mass tends to decrease. Closer spacing of blasting holes containing explosive also tends to decrease particle size.

The smaller the size of the particles in the fragmented mass, the faster heat can reach the core of the particles for retorting, and the faster the retorting zone can advance through the fragmented mass. For an economical rate of advancement of the retorting zone, the weight average diameter of particles in the fragmented mass is no more than about 0.3 foot, and preferably no more than about 0.1 foot.

However, pressure drop across the fragmented mass increases as the weight average diameter of the particles in the fragmented mass decreases. To avoid excessive energy requirements for passing gas through the fragmented mass, the weight average diameter of particles in the fragmented mass is at least about 0.02 foot, and preferably at least about 0.04 foot.

Therefore, in summary, to permit retorting of the fragmented permeable mass at an economical rate of advancement of the retorting zone, without excessive energy requirements for passing gas through the fragmented mass, the weight average diameter of particles in the fragmented mass is from about 0.02 to about 0.3 foot, and preferably from about 0.04 to about 0.1 foot.

As used herein, the term "weight average diameter" refers to a diameter, D, calculated according to the following equation:

$$D=1/\Sigma(x_i/D_i) \quad (1)$$

where $x_i$ equals the weight fraction, dimensionless, of particles of diameter $D_i$, feet.

Figure 3:
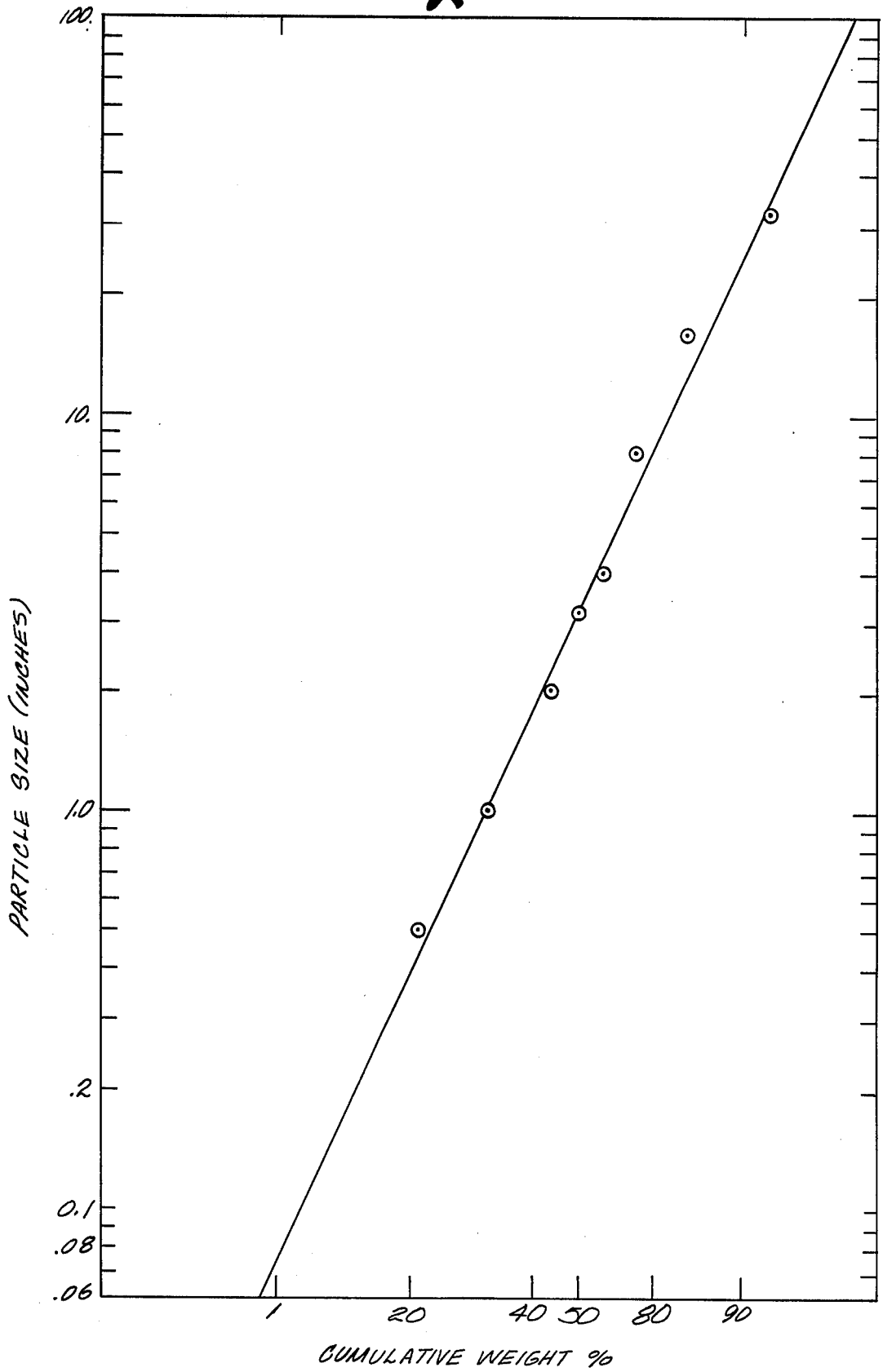
FIG. 3 is a cumulative weight percent plot of the particle size distribution of particles in an in situ oil shale retort.

A retort containing a fragmented permeable mass having a void fraction of about 20% was prepared according to the method described at column 9, line 38 to column 12, line 42 of the aforementioned U.S. Pat. No. 4,043,595. The particle size distribution of the fragmented permeable mass in the retort is shown in FIG. 3. The weight average diameter of all the particles in the fragmented mass, using equation (1), was about 0.06 foot.

Referring again to FIG. 1, a conduit 30 communicates with the top of the fragmented mass of formation particles in the retort 8. To establish a combustion zone in the fragmented mass, carbonaceous material in the oil shale is ignited by any known method as, for example, the methods described in U.S. Pat. No. 3,952,801 and the aforementioned U.S. Pat. No. 3,661,423. The U.S. Pat. No. 3,952,801 is incorporated herein by this reference. In establishing a combustion zone by a method as described in the U.S. Pat. No. 3,661,423 a combustible mixture is introduced into the retort through the conduit 30 and ignited. Gas is withdrawn through the drift 22, thereby bringing about a movement of gas from top to bottom of the retort through the fragmented permeable mass of particles containing oil shale. The combustible mixture contains an oxygen-containing gas, such as air and a fuel such as propane, butane, shale oil, diesel fuel, natural gas, or the like.

As used herein, the term "oxygen-containing gas" refers to oxygen; air; air enriched with oxygen; oxygen or air mixed with a diluent such as nitrogen, fuel, off gas from an in situ oil shale retort, or steam; and mixtures thereof.

The supply of combustible mixture to the combustion zone is maintained for a period sufficient for oil shale in the fragmented mass near the upper boundary 14 of the retort to become heated to a temperature higher than the spontaneous ignition temperature of carbonaceous material in the shale, and generally higher than about 900° F., so that the combustion zone can be sustained by the introduction of oxygen-containing gas without fuel. At a temperature higher than about 900° F., gases passing through the combustion zone and combustion gas produced in the combustion zone are at a sufficiently high temperature to retort oil shale on the advancing side of the combustion zone.

After a self-sustaining combustion zone is established in the fragmented mass, the combustion zone is advanced through the fragmented mass by introducing an oxygen containing retort inlet mixture into the in situ oil shale retort through the conduit 30 as a combustion zone feed. Oxygen introduced to the retort in the retort inlet mixture oxidizes carbonaceous material in the oil shale to produce combustion gas. The combustion zone is the portion of the retort where the greater part of the oxygen in the combustion zone feed that reacts with residual carbonaceous material in retorted oil shale is consumed. Heat from the exothermic oxidation reactions, carried by gas flow, advances the combustion zone through the fragmented mass of particles.

Combustion gas produced in the combustion zone and any unreacted portion of the combustion zone feed pass through the fragmented mass of particles on the advancing side of the combustion zone to establish a retorting zone on the advancing side of the combustion zone. Kerogen in the oil shale is retorted in the retorting zone to produce liquid and gaseous products.

The access tunnel 22 in communication with the bottom of the retort contains a sump 32 in which liquid products 34, including liquid hydrocarbon products and water, are collected to be withdrawn. An off gas 36 containing gaseous products, combustion gas, carbon dioxide from carbonate decomposition, and any gaseous unreacted portion of the combustion zone feed, is also withdrawn from the in situ oil shale retort 8 by way of the tunnel 22. The liquid products and off gas are withdrawn from the retort as effluent fluids.

Retorting of oil shale can be carried out with primary combustion zone temperatures as low as about 800° F. However, in order to have retorting at an economically fast rate, it is preferred to maintain the combustion zone at a temperature of at least about 900° F. Preferably, the primary combustion zone is maintained at a temperature of at least about 1150° F. for reaction between water and carbonaceous residue in retorted oil shale according to the water-gas reaction.

The upper limit on the temperature of the combustion zone is determined by the fusion temperature of oil shale, which is about 2100° F. The temperature in the primary combustion zone preferably is maintained below about 1800° F., and more preferably below about 1600° F., to provide a margin of safety between the temperature of the combustion zone and the fusion temperature of the oil shale. The preferred temperature range for the combustion zone is from about 1150° to about 1600° F.

In this specification, where the temperature of the combustion zone is mentioned, reference is being made to the maximum temperature in that zone.

With an in situ oil shale retort having a void fraction and average particle size as indicated above, it has been found that it is important to control the rate at which the retort inlet mixture is introduced to the retort, and thus the rate at which combustion zone feed is introduced to the combustion zone, for maintaining the modified Reynolds number of gas passing through the combustion zone in the range from about 0.1 to about 20, and preferably from about 1 to about 6. If the modified Reynolds number is less than about 0.1, the combustion and retorting zones advance through the fragmented mass at a rate that is too slow for a shale oil production rate commensurate with the preparation and equipment requirements of in situ retorting. Furthermore, slow rate of advancement means that inordinately long retorting times are involved, and pumping energy must be supplied throughout this period. In addition, slow advancement of the retorting and combustion zones appears to promote secondary thermal cracking of the shale oil produced, with a consequent loss of oil yield.

If the modified Reynolds number is greater than about 20, flow is in the transitional flow region, and there is a significant reduction in oil yield. The high rate of oxygen introduction into the retort results in a portion of the oxygen of the retort inlet mixture bypassing the combustion zone and oxidizing hydrocarbon products produced in the retorting zone. Also, significant turbulence in the transitional flow region can also require more energy for the gas blowers than with lower flow rates. Furthermore, at modified Reynolds numbers greater than about 20, the retorting zone can advance at such a fast rate, that core portions of larger particles in the fragmented mass can be left unretorted. In addition, residual carbonaceous material in the core portions of larger particles can be left uncombusted due to the high rate of advancement of the combustion zone.

Preferably, the rate at which the combustion zone feed is introduced to the combustion zone is controlled for maintaining the modified Reynolds number of gas passing through the combustion zone in the range of from about 1 to about 6 to produce shale oil at the greatest efficiency possible. This range for the modified Reynolds number provides the optimum balance between operating costs, capital costs, and yield of shale oil to produce shale oil of minimum cost.

The modified Reynolds number is defined as:

$$Re = DG/\mu(1-\epsilon) \qquad (2)$$

where D is weight average particle diameter, feet; G is the fluid superficial mass velocity based on an empty retort cross-section, lb./(sec) (sq. ft.); $\mu$ is the fluid viscosity at the maximum temperature in the combustion zone, lb./(ft.) (sec.); $\epsilon$ is the void fraction expressed as a decimal fraction ($\epsilon$=0.15 for a 15% void fraction), dimensionless. This definition of modified Reynolds number is based upon the modified Reynolds number defined by Bennett, C. O., and Meyers, J. E., *Momentum, Heat, and Mass Transfer*, McGraw-Hill Book Co., Inc., (New York, 1962), pg. 179, equation (15–20).

The fluid superficial mass velocity can be determined according to the following equation:

$$G=\rho V \quad (3)$$

where $\rho$ is the density of the combustion zone feed at standard temperature and pressure, lb./cu. ft; and V is the combustion zone feed superficial volumetric velocity based on empty retort at standard temperature and pressure, cu. ft./(sec.) (sq. ft.).

When the retort inlet mixture contains liquid, such as a liquid fuel or water, and if equation (3) is used to determine the superficial mass velocity of the combustion zone feed, the calculations must account for gaseous products of the fuel and vaporization of the water.

By operating the retort in the narrow flow regime defined by modified Reynolds numbers from about 0.1 to about 20, and preferably from about 1 to about 6, oil yield is maximized without undue cracking or combustion, and total energy consumption of the air blowers for the retort is minimized. Minimization of energy consumption of the air blowers is particularly important when retorting oil shale in a retort having a long vertical extent, i.e., retorts which are about 100 feet or longer in height. Therefore, when the dimension of the fragmented mass in the direction in which the combustion zone advances is at least about 100 feet, it is particularly important that the modified Reynolds number of gas passing through the combustion zone be maintained in the desired ranges. Surprisingly, it is found that maximum yield and minimum energy requirements approximately coincide.

For a retort containing a fragmented permeable mass having a void fraction of from about 10 to about 25% and a weight average diameter of particles in the fragmented mass from about 0.02 to about 0.3 ft., preferably the combustion zone feed is introduced to the combustion zone at a rate from about 0.5 to about 1 SCFM (standard cubic feet per minute) per square foot of cross-section of the fragmented mass to obtain a gas flow rate through the combustion zone within the preferred modified Reynolds number range. Most preferably, the combustion zone feed is introduced to the combustion zone at a rate of about 0.6 SCFM per square foot of cross-section of the fragmented mass.

The flow of gas through the retort can be varied during different stages of retorting operations since the effective void fraction of the fragmented mass changes during the retorting operations and generally tends to decrease as retorting continues. In addition, as retorting progresses and the combustion and retorting zones travel down the retort, there is an ever-increasing zone of hot combusted oil shale on the trailing side of the combustion zone. This can have the effects of increasing the pressure drop across the retort and requiring lowered total gas flow as compared with the initial stages of retorting to maintain the same total pressure drop across the retort.

Further, as retorting continues, there is some thermal degradation of the oil shale particles, and the resulting detritus can inhibit flow through some of the void volume. There is also some swelling of oil shale during retorting, and both of these effects tend to reduce the effective void volume through which gas can flow. Thus, the total flow towards the end of the retorting operation can be lower than at the beginning.

Sometimes, because of the vagaries of blasting, there is a region in the fragmented mass having a particularly low void fraction so that there is a localized high resistance to gas flow. The location of such a high flow resistance area can be ascertained by tracer gas tests prior to retorting. If the region of low void fraction is relatively near the bottom of the retort, a somewhat higher flow rate of gas can be used until such time as the retorting region and combustion zones approach the region of low void fraction. At that time, it can be desirable to reduce the gas flow so that there is no detriment to the oil yield.

If the region of relatively low void fraction is near the top of the retort, a relatively low flow rate of gas can be required throughout the retorting operation. This can be needed because the thermal degradation of the oil shale in this region further reduces the effective void fraction and increases the gas flow resistance.

Although this invention has been described in considerable detail with reference to certain versions thereof, other versions of this invention can be practiced. For example, although the invention has been described in terms of an in situ oil shale retort containing both a combustion zone and a retorting zone, it is possible to practice this invention with a retort containing only a combustion zone. In addition, although the drawing shows a retort where the combustion and retorting zones are advancing downwardly through the retort, this invention is also useful for retorts where the combustion and retorting zones are advancing upwardly or transverse to the vertical.

Because of variations such as these, the spirit and scope of the appended claims shoudl not be limited to the description of the preferred versions contained herein.

What is claimed is:

1. A method of recovering shale oil from a subterranean formation containing oil shale comprising the steps of:

forming an in situ oil shale retort containing a fragmented permeable mass of formation particles containing oil shale in the subterranean formation, wherein the void fraction of the fragmented mass is from about 10 to about 25%, and the weight average diameter of particles in the fragmented mass is from about 0.02 to about 0.3 foot;

establishing a combustion zone in the fragmented mass;

introducing a combustion zone feed containing oxygen to the combustion zone for advancing the combustion zone through the fragmented mass; and controlling the rate at which the combustion zone feed is introduced to the combustion zone for maintaining the modified Reynolds number of gas passing through the combustion zone in the range of from about 0.1 to about 20.

2. The method of claim 1 in which the modified Reynolds number of gas passing through the combustion zone is maintained in the range of from about 1 to about 6.

3. The method of claim 1 in which the combustion zone is maintained at a temperature of from about 1150° to about 1600° F.

4. The method of claim 1 in which the void fraction of the fragmented mass is from about 15% to about 25%, the weight average diameter of particles in the fragmented mass is from about 0.04 to about 1 foot, and the modified Reynolds number of gas passing through the combustion zone is maintained in the range of from about 1 to about 6.

5. The method of claim 1 in which the dimension of the fragmented mass in the direction in which the combustion zone feed is introduced to the combustion zone is at least about 100 feet.

6. The method of claim 1 in which the combustion zone is advancing downwardly through the fragmented mass, the combustion zone feed is introduced downwardly to the combustion zone, and off gas is withdrawn from the fragmented mass on the advancing side of the combustion zone.

7. The method of claim 6 in which the dimension of the fragmented mass in the direction in which the combustion zone feed is introduced to the combustion zone is at least about 100 feet.

8. In a method for recovering shale oil from an in situ oil shale retort in a subterranean formation containing oil shale, said retort having top, bottom, and side boundaries of unfragmented formation and containing a fragmented permeable mass of formation particles containing oil shale, comprising the steps of:

excavating a first portion of the formation from within the boundaries of the in situ oil shale retort being formed to form at least one void, the surface of the formation defining such a void providing at least one free face extending through the formation within said boundaries, and leaving a second portion of said formation, which is to be fragmented by expansion toward such a void, within said boundaries and extending away from a said free face, wherein the volume of such voids is from about 10 to 25% of the combined volume of the voids and of the space occupied by said second portion;

placing explosive in said second portion and detonating the placed explosive for explosively expanding unfragmented formation in the second portion toward such a void to form an in situ oil shale retort containing a fragmented permeable mass of formation particles containing oil shale having a void fraction of from about 10 to about 25% and a weight average diameter of particles in the fragmented mass in the range of from about 0.02 to about 0.3 foot;

establishing a combustion zone in the fragmented mass;

introducing a combustion zone feed comprising oxygen to the combustion zone for advancing the combustion zone through the fragmented mass and for retorting oil shale in a retorting zone on the advancing side of the combustion zone; and controlling the rate at which the combustion zone feed is introduced to the combustion zone for maintaining the modified Reynolds number of gas passing through the combustion zone in the range of from about 0.1 to about 20.

9. The method of claim 8 in which the combustion zone feed is introduced to the combustion zone at a rate of from about 0.5 to about 1 SCFM per square foot of cross-section of the fragmented mass normal to the direction of advancement of the combustion zone.

10. The method of claim 8 in which the combustion zone feed is introduced to the combustion zone at a rate of about 0.6 SCFM per square foot of cross-section of the fragmented mass normal to the direction of advancement of the combustion zone.

11. The method of claim 8 in which the modified Reynolds number of gas passing through the combustion zone is maintained in the range of from about 1 to about 6.

12. The method of claim 8 in which the combustion zone is advancing downwardly through the fragmented mass, the combustion zone feed is introduced downwardly to the combustion zone, and off gas is withdrawn from the fragmented mass on the advancing side of the combustion zone.

13. The method of claim 8 in which the height of the fragmented mass is at least about 100 feet.

14. A method for recovering shale oil from a subterranean formation containing oil shale comprising the steps of:

forming an in situ oil shale retort containing a fragmented permeable mass of formation particles containing oil shale and having a height of at least 100 feet in the subterranean formation, wherein the void fraction of the fragmented mass is from about 15 to about 25%, and the weight average diameter of of particles in the fragmented mass is from about 0.02 to about 0.3 foot;

igniting oil shale in an upper portion of the fragmented mass for establishing a combustion zone in an upper portion of the fragmented mass;

introducing a combustion zone feed comprising oxygen to the combustion zone for advancing the combustion zone downwardly through the fragmented mass and for retorting oil shale in a retorting zone on the advancing side of the combustion zone to produce shale oil and gaseous products;

withdrawing shale oil and off gas comprising gaseous products from the retort on the advancing side of the retorting zone; and controlling the rate at which the combustion zone feed is introduced to the combustion zone for maintaining the modified Reynolds number of gas passing through the combustion zone in the range of from about 1 to about 6.

15. The method of claim 14 in which the height of the fragmented mass is at least about 100 feet.

* * * * *